US009063490B2

(12) United States Patent
Tamada et al.

(10) Patent No.: US 9,063,490 B2
(45) Date of Patent: Jun. 23, 2015

(54) FIXING APPARATUS AND IMAGE FORMING APPARATUS

(71) Applicant: KONICA MINOLTA, INC., Chiyoda-ku, Tokyo (JP)

(72) Inventors: Takeshi Tamada, Toyohashi (JP); Satoshi Ogata, Hachioji (JP); Kenji Izumiya, Hachioji (JP); Hiroshi Oyama, Hino (JP); Masayuki Watanabe, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/470,375

(22) Filed: Aug. 27, 2014

(65) Prior Publication Data

US 2015/0063850 A1 Mar. 5, 2015

(30) Foreign Application Priority Data

Aug. 29, 2013 (JP) ..... 2013-177923

(51) Int. Cl.
*G03G 15/20* (2006.01)
*G03G 15/00* (2006.01)

(52) U.S. Cl.
CPC ..... *G03G 15/2053* (2013.01); *G03G 15/50* (2013.01)

(58) Field of Classification Search
None
See application file for complete search history.

(56) References Cited

U.S. PATENT DOCUMENTS 5,359,401 A 10/1994 Uehara et al.

FOREIGN PATENT DOCUMENTS

| | | | | |
|---|---|---|---|---|
| JP | 06250560 A | | 9/1994 | |
| JP | 09138598 A | | 5/1997 | |
| JP | H09-138598 | * | 5/1997 | ..... G03G 15/20 |
| JP | 10221999 A | | 8/1998 | |

* cited by examiner

*Primary Examiner* — Clayton E Laballe
*Assistant Examiner* — Jas Sanghera
(74) *Attorney, Agent, or Firm* — Holtz, Holtz, Goodman & Chick PC

(57) ABSTRACT

A fixing apparatus includes an upper pressure roller, a fixing belt, a lower pressure roller which cooperates with the upper pressure roller and the fixing belt for forming a fixing nip portion which holds and conveys a sheet with a toner image therebetween; a drive motor which rotates the lower pressure roller; a plurality of motors each of which is capable of generating a braking force in the direction to hinder rotation of the upper pressure roller and an assist force in the direction to assist rotation of the upper pressure roller; a torque generation unit which generate an effective braking force in the direction to hinder rotation of the fixing side member as a combination of the braking and assist forces; and a control unit which switches the motor used to generate the braking force among the plurality of motors in accordance with a predetermined condition.

6 Claims, 8 Drawing Sheets

FIXING APPARATUS AND IMAGE FORMING APPARATUS

CROSS-REFERENCE TO RELATED APPLICATIONS

The present application claims priority under 35 U.S.C. §119 to Japanese Patent Application No. P2013-177923, filed Aug. 29, 2013. The contents of this application are herein incorporated by reference in their entirety.

BACKGROUND OF THE INVENTION

1. Field of Invention

The present invention relates to a fixing apparatus for fixing images formed on paper and an image forming apparatus provided with this fixing apparatus.

2. Description of Related Art

In general, an image forming apparatus as an electrophotographic system (printer, copying machine, facsimile or the like) is provided with a fixing apparatus for applying heat and pressure to a sheet to fix a toner image transferred to the sheet. This fixing apparatus includes a heating unit for heating and melting toner on a sheet and a pressing unit for pressing the sheet against the heating unit.

The pressing unit of the fixing apparatus consists, for example, of a fixing roller and a pressure roller which is urged against the fixing roller with a predetermined load. A nip portion is formed between the fixing roller and the pressure roller which is directly or indirectly urged against the fixing roller to hold and convey a sheet therebetween.

The heating unit of the fixing apparatus consists of a heat source (for example, halogen heater) contained in the pressure roller, and an endless fixing belt which is wound around the fixing roller (heating belt type). In this case, a nip portion is formed by urging the pressure roller against the fixing roller through the fixing belt. Alternatively, the fixing roller may incorporate a heat source, and serves itself as a heating unit (heating roller type). In this case, the pressure roller is urged directly against the fixing roller while a nip portion is formed therebetween.

The image forming apparatus having such a fixing apparatus develops toner images on photoreceptor drums in correspondence with image data, and transfers the toner images on a sheet. The sheet with the transferred toner images is conveyed to the fixing apparatus, and passed through the nip portion to fix the toner images with heat and pressure.

This kind of fixing apparatus is described, for example, in Japanese Patent Published Application No. 06-250560, Japanese Patent Published Application No. 10-221999, and Japanese Patent Published Application No. 09-138598.

In the case of the fixing apparatuses described in Japanese Patent Published Application No. 06-250560 and Japanese Patent Published Application No. 10-221999, a nip portion is formed with a fixing roller on which is partly wound an endless belt running around a plurality of rollers. The fixing apparatus includes a pressure roller located in contact with the fixing roller through the endless belt from the inside of the endless belt at the exit of the nip portion. The fixing apparatus prevents displacement of images by exerting a braking force on the endless belt conveyed on the pressure roller in order to remove the difference in the conveyance speed between the pressure roller and the fixing roller. On the other hand, in the case of the fixing apparatus described in Japanese Patent Published Application No. 09-138598, a heat-resistant belt is supported by a plurality of rollers around which this belt is wound. This fixing apparatus includes a pressure roller urged in contact with a plurality of rollers through the heat-resistant belt. A tension is given to the heat-resistant belt by controlling the plurality of rollers.

When fixing toner in the fixing apparatus, the surface of a sheet bearing an unfixed toner image comes in direct contact with a heating unit (fixing belt or fixing roller). Accordingly, a latent image may be formed on the heating unit with wax, which is soaked from toner and attached to the heating unit (fixing belt or fixing roller), and may appear on the next image. More specifically, when fixing toner to form the next image, the wax attached to the heating unit appears as the unevenness of gloss (referred to as a gloss memory) corresponding to the unevenness of the attached wax amount.

There is a demand to clear such a gloss memory when fixing toner in a fixing apparatus and improve the image quality. However, such a gloss memory cannot be prevented from occurring in the fixing apparatuses described in Japanese Patent Published Application No. 06-250560, Japanese Patent Published Application No. 10-221999, and Japanese Patent Published Application No. 09-138598.

The applicant has proposed therefore a fixing apparatus comprising: a fixing side member configured to rotate; a back side member configured to rotate in contact with the outer peripheral surface of the fixing side member under pressure, and cooperate with the fixing side member for forming a fixing nip portion which holds and conveys a sheet with a toner image therebetween; a drive motor configured to rotate the back side member; and an effective braking force generation unit configured to generate an effective braking force in the direction to hinder rotation of the fixing side member to set a differential speed between the surface speed of the fixing side member and the surface speed of the back side member.

With this fixing apparatus, it is possible to make the fixing side member and the sheet slip on each other at the fixing nip portion by the differential speed which is set between the surface speed of the fixing side member and the surface speed of the back side member, and therefore solve the gloss memory problem.

Incidentally, the effective braking force generation unit of this fixing apparatus includes a motor which generates a braking force exerted on the fixing side member to hinder rotation thereof. However, a sheet is passed through the fixing nip portion of this fixing apparatus on which a braking force is being exerted by the motor. Because of this, the motor functions as an electric generator. The temperature of the motor therefore tends to rise and be broken.

SUMMARY OF THE INVENTION

To achieve at least one of the abovementioned objects, a fixing apparatus comprises: a fixing side member configured to rotate; a back side member configured to rotate in contact with the outer peripheral surface of the fixing side member under pressure, and cooperate with the fixing side member for forming a fixing nip portion which holds and conveys a sheet with a toner image therebetween; a drive motor configured to rotate the back side member; a braking force generation unit including a plurality of motors each of which is capable of generating a braking force in the direction to hinder rotation of the fixing side member and an assist force in the direction to assist rotation of the fixing side member, and configured to generate an effective braking force in the direction to hinder rotation of the fixing side member as a combination of the braking and assist forces; a control unit configured to switch the motor used to generate the braking force among the plurality of motors in accordance with a predetermined condition.

Also, to achieve at least one of the abovementioned objects, an image forming apparatus comprises: an image forming unit configured to form a toner image on a sheet; and a fixing unit as recited in the previous paragraph to fix the toner image formed on the sheet.

DETAILED DESCRIPTION OF THE PREFERRED EMBODIMENT

Hereinafter, a description is given of embodiments of the present invention with reference to the drawings.

Figure 1:
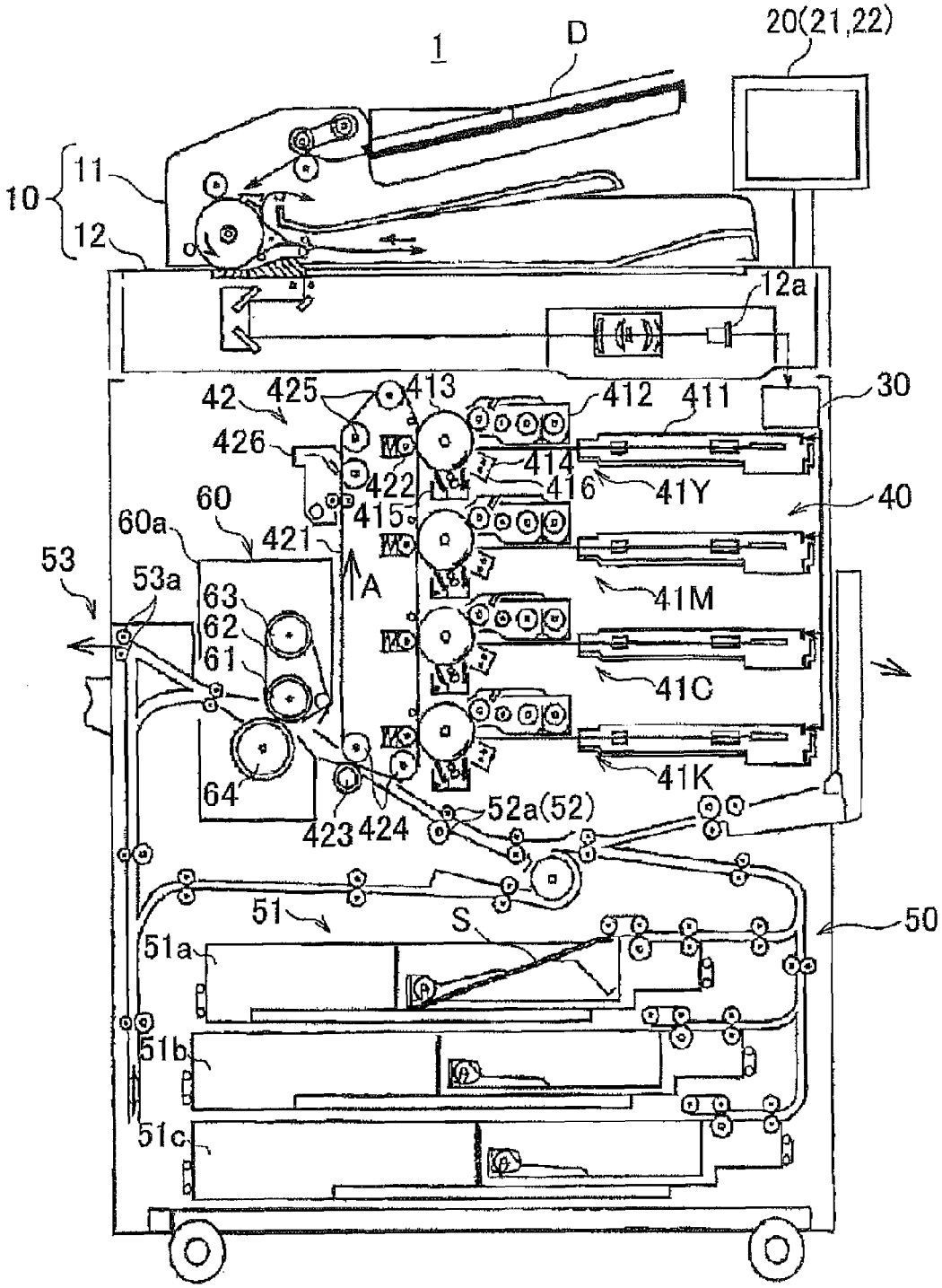
FIG. 1 is a schematic diagram for showing the overall configuration of an image forming apparatus in accordance with an embodiment of the present invention.
Figure 2:
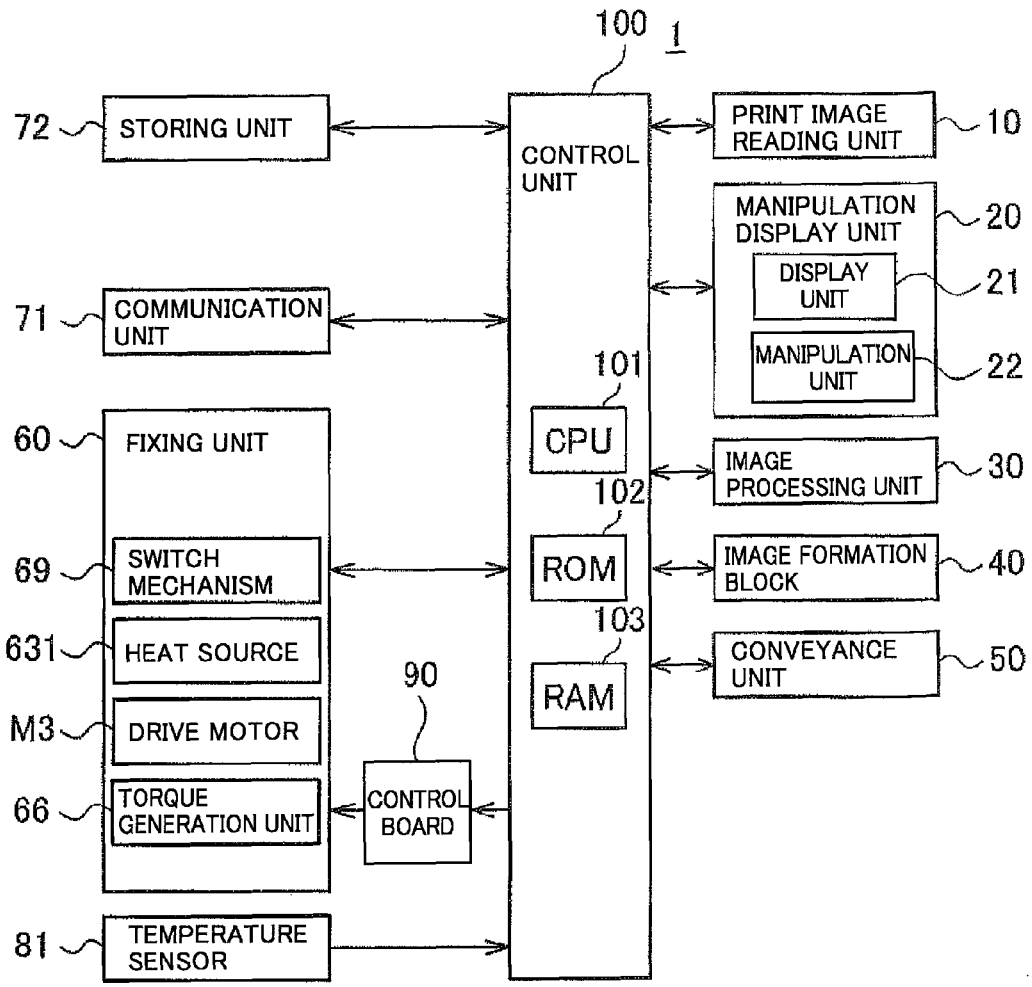
FIG. 2 is a schematic diagram for showing the main architecture of a control system of the image forming apparatus in accordance with the embodiment.

FIG. 1 is a schematic diagram for showing the overall configuration of the image forming apparatus 1 in accordance with an embodiment of the present invention. FIG. 2 is a schematic diagram for showing the main architecture of a control system of an image forming apparatus 1 in accordance with this embodiment. The image forming apparatus 1 shown in FIG. 1 and FIG. 2 is an intermediate transfer-type color image forming apparatus which makes use of an electrophotographic process technique. This image forming apparatus 1 transfers toner images of respective colors, i.e., C (cyan), M (magenta), Y (yellow) and K (black) to an intermediate transfer member (as a first transfer process). After superimposing four color toner images on the intermediate transfer member, an image is formed on a sheet by transferring the superimposed toner images (as a second transfer process).

The image forming apparatus 1 is provided with photoreceptor units which are serially arranged in the running direction of the intermediate transfer member corresponding to the four colors C, M, Y and K respectively. The image forming apparatus 1 is based on a tandem system which successively transfers four color toner images on the intermediate transfer member in one cycle.

As shown in FIG. 1 and FIG. 2, the image forming apparatus 1 includes a print image reading unit 10, a manipulation display unit 20, an image processing unit 30, an image formation block 40, a conveyance unit 50, a fixing unit 60, a communication unit 71, a storing unit 72 and a control unit (control means) 100.

The control unit 100 includes a CPU (Central Processing Unit) 101, a ROM (Read Only Memory) 102 and RAM (Random Access Memory) 103 and the like. The CPU 101 reads a program from the ROM 102 in accordance with a task, loads the program in the RAM 103, and run the program to control the operations of the respective blocks of the image forming apparatus 1 integrally. At this time, the control unit 100 refers to a variety of data stored in the storing unit 72. The storing unit 72 stores various data items required for fixing process in the fixing unit 60. The storing unit 72 consists of a nonvolatile semiconductor device (so-called flash memory), a hard disk drive or the like.

The control unit 100 performs, through the communication unit 71, transmission to and reception from an external device (for example, a personal computer) which is connected to a LAN (Local Area Network), a WAN (Wide Area Network) or the like communication network. The control unit 100 receives image data, for example, from an external device, and forms an image on a sheet on the basis of this image data (input image data). The communication unit 71 consists, for example, of a communication control card such as a LAN card.

The print image reading unit 10 is provided with an automatic page feeding unit 11 called an ADF (Auto Document Feeder), an original image scanning unit (scanner) 12 and the like.

The automatic page feeding unit 11 conveys an original D by a conveyance mechanism and transfers the original D to the original image scanning unit 12. The automatic page feeding unit 11 is capable of successively feeding a number of originals D to scan the images of the originals D (inclusive of the images of the back sides) collectively with the original image scanning unit 12.

The original image scanning unit 12 optically scans an original, which is conveyed from the automatic page feeding unit 11 and placed on a contact glass, and reads the image by imaging light reflected from the original on a light receiving plane of a CCD (Charge Coupled Device) sensor 12*a*. The print image reading unit 10 generates input image data on the basis of the scan data obtained by the original image scanning unit 12. This input image data is processed by the image processing unit 30 in accordance with a predetermined image process.

The manipulation display unit 20 is a liquid crystal display (LCD: Liquid Crystal Display) with a touch panel and serves as a display unit 21 and a manipulation unit 22. The display unit 21 displays various operation screens, image conditions, the operational states of respective functions and so forth in accordance with a display control signal which is input from the control unit 100. The manipulation unit 22 is provided with a numerical keypad, a start key and other various operational keys, accepts various input operations from a user and outputs an operation signal to the control unit 100.

The image processing unit 30 is provided with a circuit or the like which performs digital image processes in accordance with initial settings or user settings. For example, the image processing unit 30 performs a variety of processes with the input image data such as gradation level adjustment, color correction, shading compensation and other various correction processes, and compression processes under the control of the control unit 100. The image formation block 40 is controlled on the basis of the image data processed by these processes.

The image formation block 40 is provided with image forming units 41Y, 41M, 41C and 41K, an intermediate transfer unit 42 and the like for forming an image on the basis of the input image data with colored toners corresponding to a Y component, an M component, a C component and a K component respectively.

The image forming units 41Y, 41M, 41C and 41K corresponding to the Y component, the M component, the C component and the K component shares the same configuration except for the colors of the toners. For the sake of clarity in explanation and illustration, like numerals denote similar elements, and suffixes Y, M, C and K may be added to the ends of the numerals respectively for distinguishing from each other. In FIG. 1, only the constituent elements of the image forming unit 41Y are given reference numerals corresponding to the Y component, but the reference numerals are omitted for the constituent elements of the other image forming units 41M, 41C and 41K.

The image forming unit 41 is provided with an exposing device 411, a development apparatus 412, a photoreceptor drum 413, a charging unit 414, a drum cleaning unit 415, a lubricant coating unit 416 and the like.

The photoreceptor drum 413 consists, for example, of a conductive cylinder (aluminum blank tube) on which an under coat layer (UCL layer), a charge generation layer (CGL layer), and a charge transport layer (CTL layer) are successively stacked as a negative electrification type organic photoconductor (OPC).

The charging unit 414 uniformly charges the surface of the photoreceptor drum 413 having photoconductivity with negative charge. The exposing device 411 consists, for example, of a semiconductor laser and irradiates the photoreceptor drum 413 with a laser light corresponding to an image of the color component which the photoreceptor drum 413 is responsible for. The laser light generates positive charge in the charge generation layer. The generated charge is transported to the surface of the charge transport layer to neutralize the surface charge (negative charge) of the photoreceptor drum 413. An electrostatic latent image is formed on the surface of the photoreceptor drum 413 corresponding to each color component by the potential difference between the surface and the environment.

A developer of each color component (for example, a two-component developer consisting of a magnetic material and a toner and having small particle diameters) is stored in the development apparatus 412, and gets adhered to the surface of the photoreceptor drum 413 to form a toner image by visualizing an electrostatic latent image corresponding to the each color component.

Meanwhile, in this case, the toner stored in the development apparatus 412 is a toner containing dispersed wax (oil-less toner). The melting point of the wax contained in this toner is low, i.e., usually no higher than 110° C. This wax may be any one or a mixture of a paraffin-based wax, a polyolefin-based wax and modified matters of them (for example, oxides and grafted matters), a higher fatty acid and a metal salt thereof, an amide wax, an ester-based wax and any other known wax. For example, a higher fatty acid ester-based wax can be used as a preferred wax.

The drum cleaning unit 415 has a drum cleaning blade (hereinafter referred to as DCL blade) which is in slidable contact with the surface of the photoreceptor drum 413. The DCL blade is used to scrape and remove the residual toner which is lingering on the surface of the photoreceptor drum 413 after the first transfer process.

The lubricant coating unit 416 has a lubricant coating brush in the form of a roller which is in slidable contact with the surface of the photoreceptor drum 413. When the photoreceptor drum 413 is rotating, the lubricant coating unit 416 is coating the surface of the photoreceptor with lubricant adhering to the lubricant coating brush.

The intermediate transfer unit 42 is provided with an intermediate transfer belt 421, first transfer rollers 422, a second transfer roller 423, driven rollers 424, non-driven rollers 425 and a belt cleaning unit 426 and so forth.

The intermediate transfer belt 421 is an endless belt which is wound around the driven rollers 424 and the non-driven rollers 425. The intermediate transfer belt 421 is driven by rotation of the driven rollers 424 to run in the direction of arrow A at a constant speed. The first transfer rollers 422 urge the intermediate transfer belt 421 against the photoreceptor drums 413 so that toner images of the respective colors are successively transferred to the intermediate transfer belt 421 as the first transfer process. Then, when the intermediate transfer belt 421 is urged against a sheet S by the second transfer roller 423, the toner image transferred to the intermediate transfer belt 421 as the first transfer process is transferred to the sheet S as the second transfer process.

The belt cleaning unit 426 has a belt cleaning blade (hereinafter referred to as BCL blade) which is in slidable contact with the surface of the intermediate transfer belt 421. The BCL blade is used to scrape and remove the residual toner which is lingering on the surface of the intermediate transfer belt 421 after the second transfer process.

An toner image is formed on the sheet S in this way.

The toner image is fixed on the sheet S by the fixing unit 60. The fixing unit 60 fixes the toner image on the sheet S with heat and pressure. This fixing unit 60 mainly includes an upper pressure roller 61 serving as a fixing roller located in a frame 60*a*, and a lower pressure roller 64 serving as a pressure roller. The fixing unit 60 of the present embodiment employs a belt nip type configuration which will be described below in detail.

The conveyance unit 50 is provided with a paper feed unit 51, a conveyance mechanism 52 and a discharging unit 53. The paper feed unit 51 includes three paper feed tray units 51*a* to 51*c* for storing sheets S (standard sheets, special sheets) which are classified on the basis of paper densities and sizes of sheets and separately stored in the paper feed tray units 51*a* to 51*c* in accordance with predetermined sheet types respectively.

The sheets S stored in the paper feed tray units 51*a* to 51*c* are fed out from the uppermost sheet one by one, and conveyed to the image formation block 40 by the conveyance mechanism 52 equipped with a plurality of conveyance rollers such as the paper stop rollers 52*a*. The orientation and transfer timing of the sheet S which is fed are adjusted by a registration unit including the paper stop rollers 52*a*.

The toner images of the intermediate transfer belt 421 are superimposed on one side of the sheet S by the image formation block 40 as the second transfer process, and fixed by the fixing unit 60 as a fixing process. The sheet S on which the superimposed image is formed is discharged out of the apparatus by the discharging unit 53 having discharging rollers 53*a*.

Figure 3:
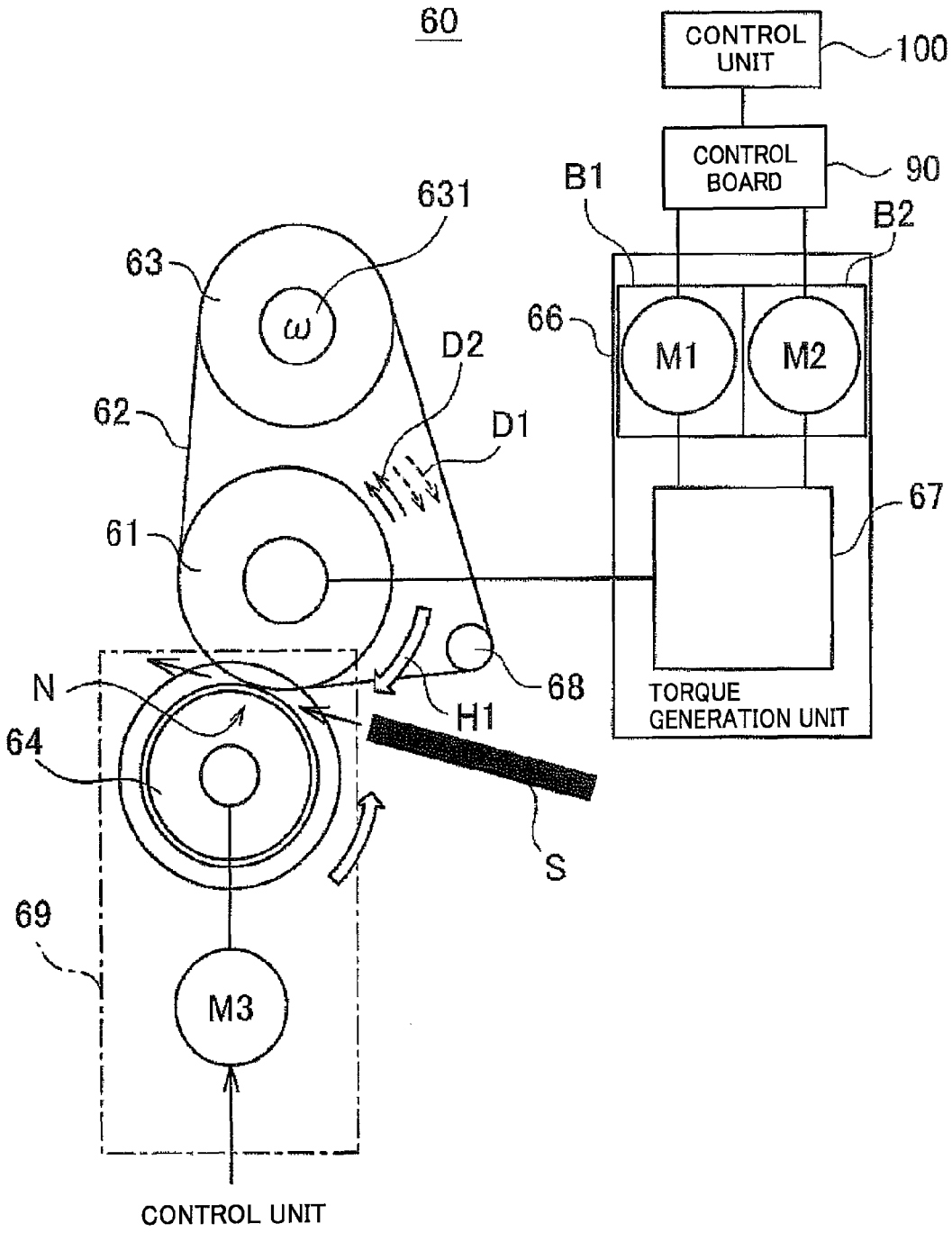
FIG. 3 is a schematic diagram for showing the configuration of the fixing unit shown in FIG. 1.

In what follows, the configuration of the fixing unit 60 of the present embodiment will be explained in detail with respect to FIG. 3. FIG. 3 is a schematic diagram for showing the configuration of the fixing unit 60 shown in FIG. 1.

The fixing unit 60 is, for example, of a heating belt type and includes the pressing unit which forms a fixing nip portion for holding (nipping) and conveying a sheet S, the heating unit which comes in contact with the sheet S for heating at a fixing temperature and so forth.

The fixing unit 60 includes the frame 60*a*, the upper pressure roller (fixing side member) 61 and the lower pressure roller (back side member) 64 as described above. In addition to this, this fixing unit 60 is provided with a fixing belt (fixing side member) 62, a heat roller 63, a stretching member 68 and a torque generation unit (effective braking force generation unit) 66. The fixing unit 60 serves as a fixing apparatus with the control unit 100 and the above members.

The upper pressure roller 61 is a cylindrical metallic core made of iron or the like on which an elastic layer is formed of a silicone rubber or the like. In addition to this, a surface release layer of a fluorine resin may sometimes be formed on the outer peripheral surface of the elastic layer. The upper pressure roller 61 having such a structure can rotate to follow the lower pressure roller 64 together with the fixing belt 62 by being urged through the fixing belt 62 against the lower pressure roller 64 which is rotationally driven by a drive motor M3.

The fixing belt 62 is an endless belt member running around the upper pressure roller 61, the heat roller 63 and the stretching member 68. This fixing belt 62 serves as a heating member for heating a sheet S at a predetermined temperature when the sheet S comes in contact with the fixing belt 62. In this case, the predetermined temperature is a temperature required for supplying necessary heat to melt toner and depends, for example, on the paper type of a sheet used for printing an image.

The heat roller 63 incorporates a heat source 631 such as a halogen heater which heats the cylindrical metallic core made of aluminum or the like and the resin layer made of PTFE (polytetrafluoroethylene) or the like so that the fixing belt 62 is heated. Furthermore, a temperature sensor 81 for control is provided in the vicinity of the fixing belt 62 to detect the temperature of the fixing belt 62 (refer to FIG. 2). The temperature sensor 81 outputs a detection signal to the control unit 100. The control unit 100 controls the output of the heat source 631 of the heat roller 63 (for example, through on/off control) in order to adjust the temperature measured by the temperature sensor 81 to a predetermined temperature.

Incidentally, the fixing belt 62 consists of a base film made, for example, of a heat-resistant polyimide having an outer peripheral surface on which are successively stacked an elastic layer made of a silicone rubber or the like and a surface release layer made of a fluorine resin. The fluorine resin is a material which contains PFA (perfluoroalkoxyalkane), PTFE or FEP (ethylenetetrafluoride-propylenehexafluoride copolymer). More preferably, the fluorine resin is one of PFA, PTFE or FEP. This configuration improves the releasability of the surface of the fixing belt 62 against wax contained in the toner resin and toner particles so that toner hardly adheres to the surface of the fixing belt 62 when fixing the toner.

The fixing belt 62 may be heated by electromagnetic induction (IH: Induction Heating). In this case, the fixing belt is basically made of a material such as Ni which can be heated by electromagnetic induction.

The stretching member 68 is a roller rotatably supported at both ends whose outer diameters are larger than that of its center portion in the form of a reversed crown. The stretching member 68 is located in a predetermined position apart from the upper pressure roller 61 and the lower pressure roller 64. The stretching member 68 is provided to shift relative to the upper pressure roller 61 and the lower pressure roller 64 and can adjust the tension of the fixing belt 62 by shifting. Alternatively, instead of such a configuration, while the stretching member 68 is fixed, the tension of the fixing belt 62 can be adjusted by providing the heat roller 63 capable of moving.

Furthermore, the fixing unit 60 is provided with a switch mechanism 69. The switch mechanism 69 is provided with an urging means for urging the lower pressure roller 64 against the upper pressure roller 61, and can move the lower pressure roller 64 into and out of engagement with the upper pressure roller 61 as engagement/disengagement operation. The engagement/disengagement operation is controlled by the control unit 100.

Also, when the lower pressure roller 64 is engaged with the upper pressure roller 61, the lower pressure roller 64 is pressed by the upper pressure roller 61 to come in pressure contact with the outer peripheral surface of the fixing belt 62 while rotating to form a fixing nip portion (hereinafter referred to as "nip portion") N for holding and conveying a sheet S, on which a toner image is formed, therebetween. Meanwhile, the lower pressure roller 64 may incorporate a heat source such as a halogen heater.

In addition to this, the fixing unit 60 is provided with the drive motor M3 for rotationally driving the lower pressure roller 64. The drive motor M3 is controlled by the control unit 100.

the torque generation unit 66 is provided with a first and a second motor M1 and M2, a first and a second motor board B1 and B2 controlled by the control unit 100 for driving the first and second motors M1 and M2, and a gear mechanism 67. When the sheet S conveyed to the nip portion N is a predetermined cardboard or the like, this torque generation unit 66 generates a braking force in the direction to hinder rotation of the fixing belt 62 through the gear mechanism 67 by the first and second motors M1 and M2 in order to adjust the differential speed between the surface speed of the fixing belt 62 and the surface speed of the lower pressure roller 64. The fixing belt 62 can rotate by following the lower pressure roller 64 which is rotationally driven by the drive motor M3. The torque generation unit 66 generates a braking force in the direction to hinder this following rotation. The fixing belt 62 and the sheet S slip thereby on each other to prevent a gloss memory.

Meanwhile, when the sheet S conveyed to the nip portion N is a predetermined thin sheet (for example, a sheet S having a paper density of no greater than 81 $g/m^2$) or a special cardboard such as a cardboard made of coated paper, the torque generation unit 66 does not generate a braking force but does generate an assist force in the direction to assist the rotation of the fixing belt 62. In this case, the torque generation unit 66 generates an assist force in the direction to assist the following rotation of the fixing belt 62. The sheet S is thereby prevented from wrinkling.

More specifically, the first and second motors M1 and M2 applies opposite torques respectively to the upper pressure roller 61. For example, in order to generate a braking force D2 against the rotation (forward rotation) of the upper pressure roller 61 corresponding to the transfer direction H1, the first electric motor M1 applies a torque opposite to the forward rotation to the upper pressure roller 61 which is rotating following the lower pressure roller 64. On the other hand, the second electric motor M2 generates an assist force D1 to assist the upper pressure roller 61 which is rotating following the lower pressure roller 64 to rotate in the direction corresponding to the transfer direction H1 by applying generating a torque assisting the forward rotation to the upper pressure roller 61. Incidentally, in accordance with the present embodiment as described below, the first electric motor M1 can not only generate a braking force but also generate an assist force, and the second electric motor M2 can not only generate an assist force but also generate a braking force.

The gear mechanism 67 includes a plurality of gear groups for separately transmitting the rotations of the first and second motors M1 and M2 to the upper pressure roller 61. When generating a braking force, the torques of the first and second motors M1 and M2 are transmitted in combination to the upper pressure roller 61 through these gear groups.

Figure 4:
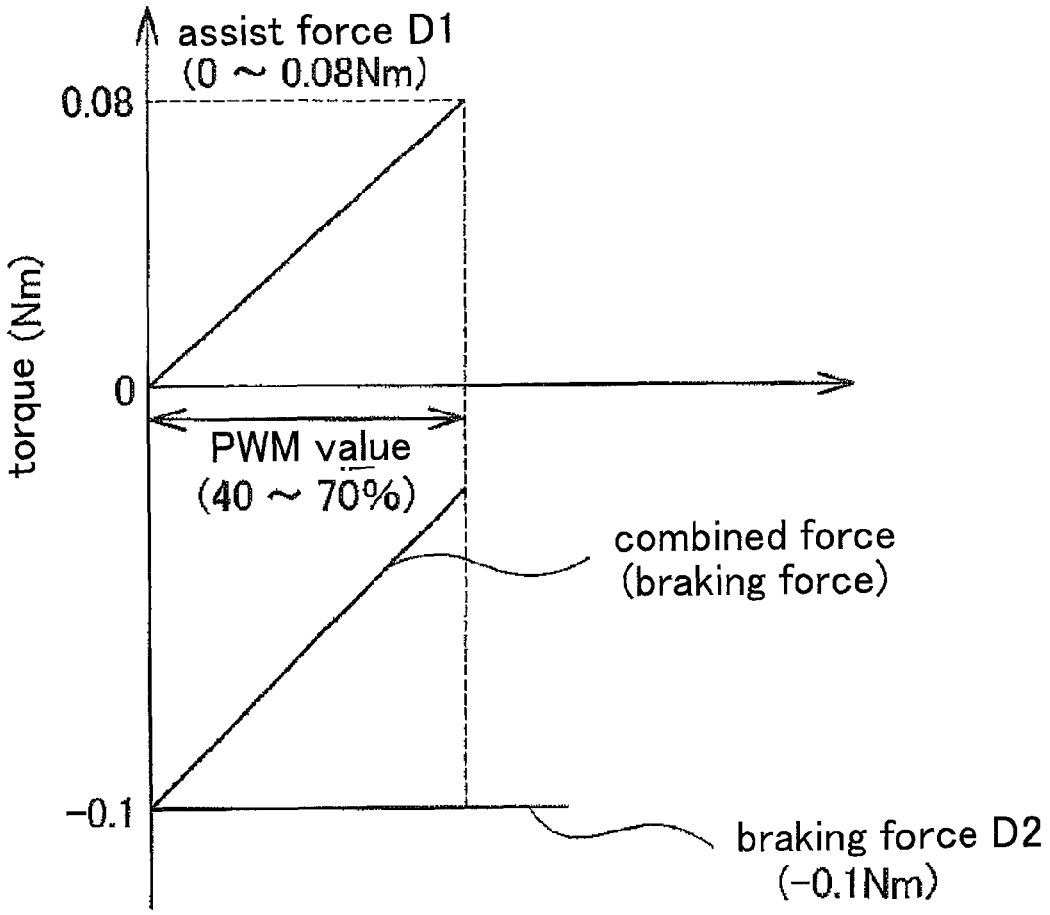
FIG. 4 is a schematic diagram for showing the effective braking force generated by the torque generation unit shown in FIG. 3.

FIG. 4 is a schematic diagram for showing the effective braking force generated by the torque generation unit 66. As shown in FIG. 4, the torque (braking force D2) generated by one of the first and second motors M1 and M2 is constant, i.e., −0.1 Nm in this case. On the other hand, the other of the first and second motors M1 and M2 is controlled by the control unit 100 in accordance with PWM (Pulse Width Modulation) to generate a variable torque (assist force D1) in a range of 0 Nm to 0.08 Nm (PWM value=40% to 70% in terms of duty cycle). The assist force D1 is thus always smaller than the braking force D2 (exactly, the absolute value of the assist force D1 is always smaller than the absolute value of the braking force D2), such that the combined force of the assist force D1 and the braking force D2 becomes a variable braking force. The combined force is the effective braking force generated by the torque generation unit 66 and exerted on the upper pressure roller 61, and set to reduce the surface speed (circumferential speed) of the upper pressure roller 61 by 0.3% to 0.8% relative to the surface speed (circumferential speed) of the lower pressure roller 64, resulting in slip between the fixing belt 62 and a sheet S.

On the other hand, when a predetermined thin sheet or the like is conveyed to the nip portion N, the control unit 100 stops one of the first and second motors M1 and M2, and makes the other operate with a constant PWM value. A constant assist force D1 is therefore applied to the upper pressure roller 61 when a predetermined thin sheet or the like is conveyed.

Figure 5:
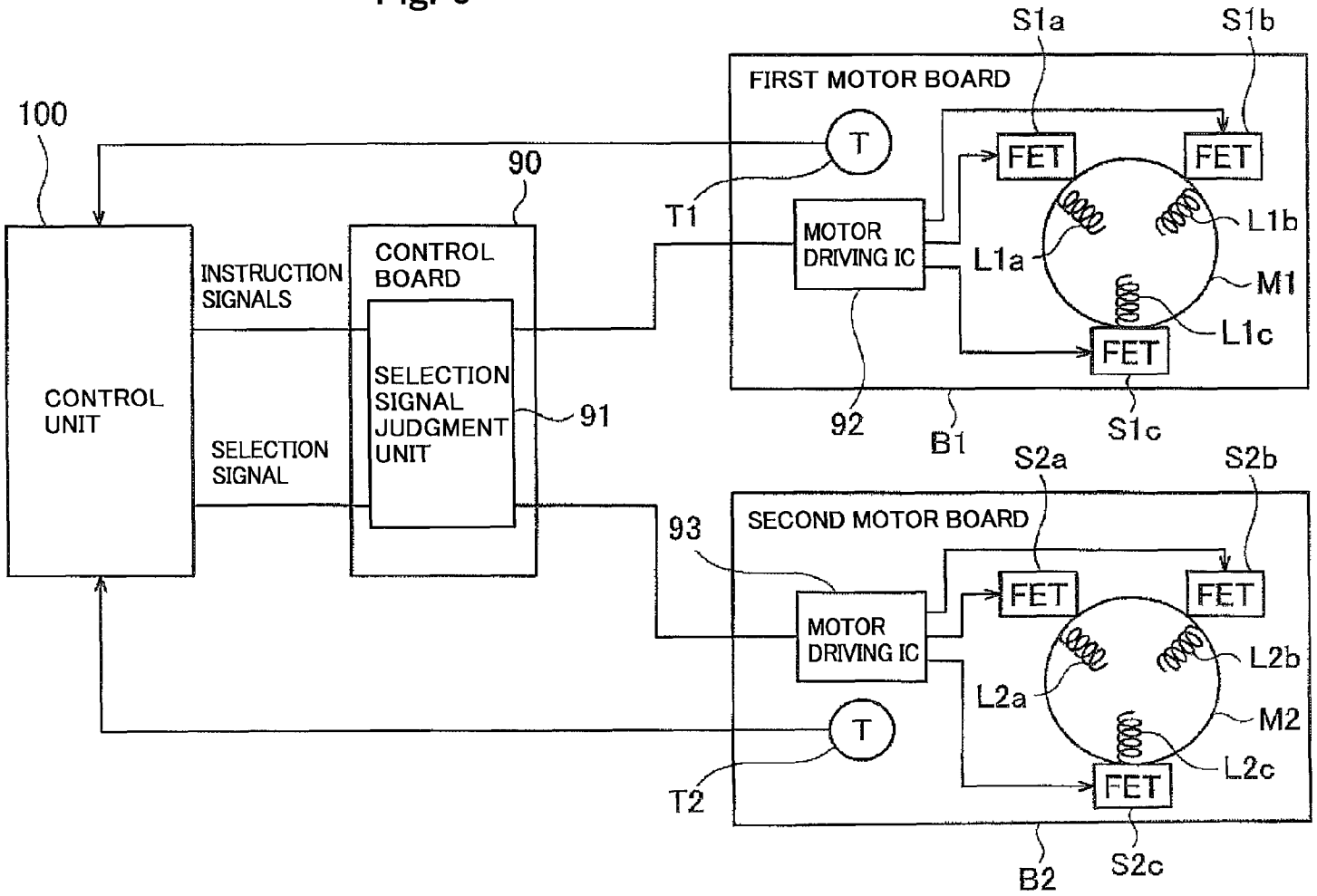
FIG. 5 is a block diagram for partially showing the configuration of the fixing unit shown in FIG. 3 in detail.

Referring to FIG. 3 again, the fixing unit 60 of the present embodiment is provided with the control board 90 and capable of switching the motor for generating the braking force D2 between the first and second motors M1 and M2. FIG. 5 is a block diagram for partially showing the configuration of the fixing unit 60 shown in FIG. 3 in detail.

As shown in FIG. 5, the fixing unit 60 includes the control board 90 which is connected to the control unit 100, and motor board B1 and B2 connected to the control board 90, and temperature sensors T1 and T2.

The control unit 100 outputs instruction and selection signals to the control board 90 to generate an effective braking force. The selection signal is a signal for selecting one of the first and second motors M1 and M2 to generate the assist force D1. The other of the first and second motors M1 and M2 is used to generate the braking force D2. The instruction signals include assist and brake signals. When receiving the assist signals, the motor board B1 or B2 drives the motor M1 or M2 to generate the assist force D1. On the other hand, when receiving the brake signal (a high-level brake signal shown in FIG. 7 as described below), the motor board B1 or B2 drives the motor board M1 or M2 to generate a braking force D2. The assist signals consist of an excitation signal for rotationally driving the motor M1 or M2, a rotation signal for designating a rotation direction, and a PWM signal for determining the value of the assist force D1.

The control board 90 receives the instruction signals and the selection signal from the control unit 100, and is provided with a selection signal judgment unit 91. The selection signal judgment unit 91 determines which of the motors M1 and M2 is to generate the braking force D2 and which of the motors M1 and M2 is to generate the assist force D1 in accordance with the selection signal output from the control unit 100. In addition to this, the selection signal judgment unit 91 receives the instruction signals, and outputs the brake signal to the motor board B1 or B2 for controlling the motor M1 or M2 which is determined to generate the braking force D2, and the assist signals to the other motor board B1 or B2 for controlling the other motor M1 or M2 which is determined to generate the assist force D1.

Furthermore, the fixing unit 60 of the present embodiment switches the destination of the brake signal and the destination of the assist signals in accordance with the selection signal. Accordingly, the fixing apparatus can switch the motor for generating the braking force D2 between the motors M1 and M2. It is therefore possible to successively switch the motor which functions as an electric generator and distribute heat between the motors M1 and M2.

The motor boards B1 and B2 have the similar configuration and are provided with motor driving ICs 92 and 93 and FETs S1*a* to S1*c* and S2*a* to S2*c* respectively. The motor driving IC 92 of the first motor board B1 serves to turn on/off FETs S1*a* to S1*c*. Likewise, the motor driving IC 93 of the second motor board B2 serves to turn on/off FETs S2*a* to S2*c*.

When receiving the assist signals, the motor driving ICs 92 and 93 of the motor boards B1 and B2 turn on/off FETs S1*a* to S1*c* and S2*a* to S2*c* respectively. Currents are passed with appropriate timings through coils L1*a* to L1*c* and L2*a* to L2*c* forming the stators of the motors M1 and M2 respectively to rotate the rotors (not shown in the figure). In this case, the motor driving ICs 92 and 93 turns on/off FETs S1*a* to S1*c* and S2*a* to S2*c* in accordance with the PWM signal contained in the instruction signals to adjust the assist force D1.

On the other hand, when receiving the brake signal (a high-level brake signal shown in FIG. 7 as described below) the motor driving ICs 92 and 93 turns on one of FETs S1*a* to S1*c* and S2*a* to S2*c*. Thus, the rotor, the force that maintains its position is applied, the braking force D2 having a constant value occurs.

The temperature sensors T1 and T2 are installed on the motor boards B1 and B2 respectively. The temperature sensors T1 and T2 detect the temperatures of the first and second motors M1 and M2 and driver circuits for driving the first and second motors M1 and M2, i.e., the motor driving ICs 92 and 93 and the FETs S1*a* to S1*c* and S2*a* to S2*c* respectively. The temperatures detected by the temperature sensors T1 and T2 are notified to the control unit 100. The temperature sensors T1 and T2 may be provided only for detecting the first and second motors M1 and M2 or only for detecting the driver circuits.

Figure 6:
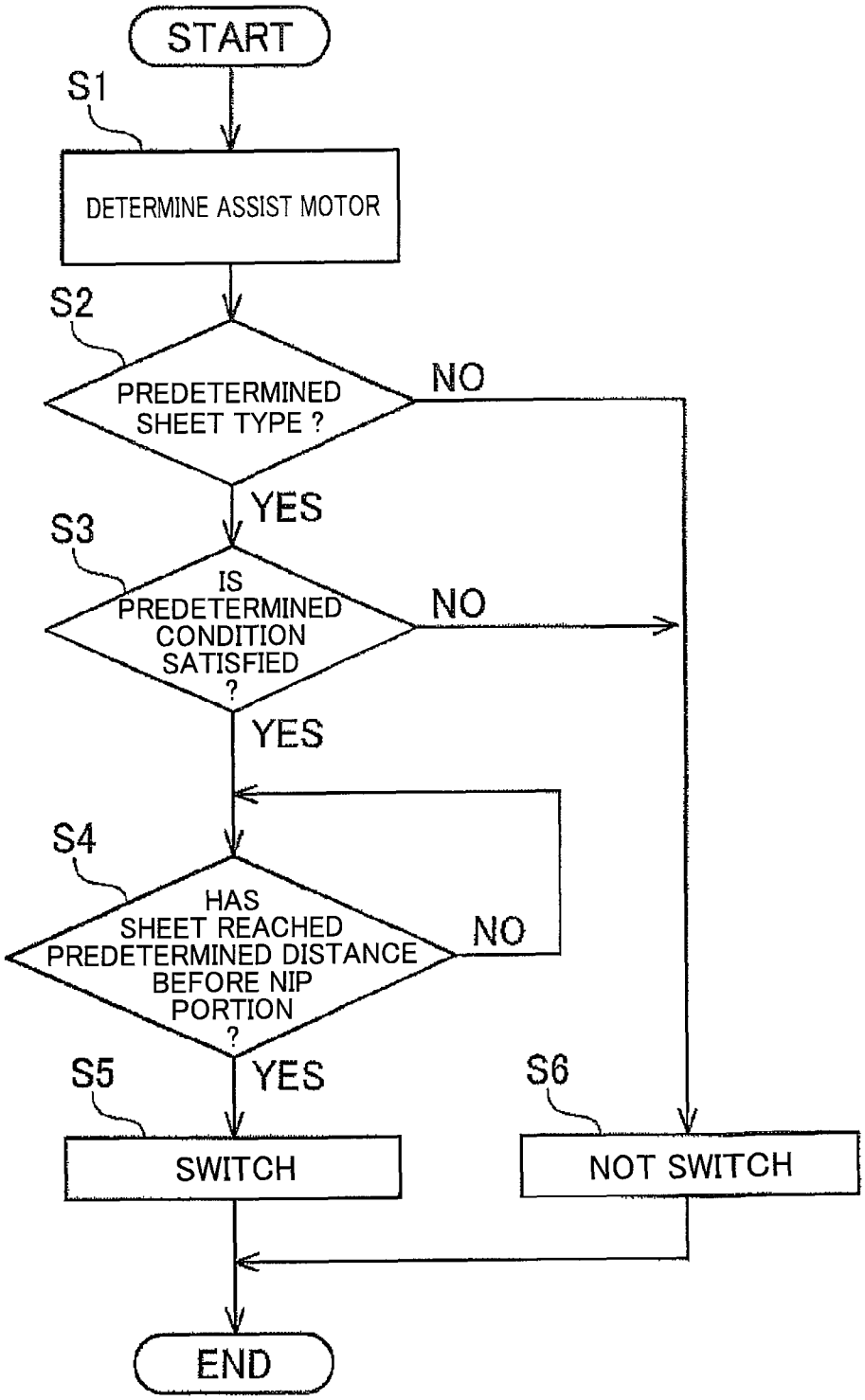
FIG. 6 is a flow chart showing an example of the operation of the fixing apparatus in accordance with the present embodiment.

Next, the operation of the fixing apparatus of the present embodiment will be explained. FIG. 6 is a flow chart showing an example of the operation of the fixing apparatus in accordance with the present embodiment. Incidentally, the process shown in FIG. 6 is repeated until the image forming apparatus 1 is powered off.

As shown in FIG. 6, the control unit 100 selects one of the first and second motors M1 and M2 to generate the assist force D1 (S1). The control unit 100 then outputs the selection signal corresponding to the selection. The selection signal judgment unit 91 determines which of the motors M1 and M2 is to generate the assist force D1 and which of the motors M1 and M2 is to generate the braking force D2 in accordance with the selection signal.

Next, the control unit 100 determines whether or not the sheet S conveyed to the nip portion N is a predetermined sheet type (S2). That is, the control unit 100 determines whether or not the sheet S is of such a sheet type which requires application of the effective braking force. If it is determined that the sheet S conveyed to the nip portion N is not a predetermined sheet type (S2: NO), the control unit 100 terminates the process shown in FIG. 6 (S6) without switching the motor for generating the braking force D2. Meanwhile, in this case, the control unit 100 outputs the instruction signals including the assist signals and a low-level brake signal shown in FIG. 7 as described below. The selection signal judgment unit 91 then outputs the assist signals to one of the motor boards B1 and B2 on which is mounted the motor M1 or M2 determined as the motor used to generate the assist force D1 in step S1, and the assist force D1 is generated in accordance with the assist signals. On the other hand, the selection signal judgment unit 91 outputs a low-level brake signal to the other of the motor boards B1 and B2 so that the braking force D2 is not generated.

On the other hand, if it is determined that the sheet S conveyed to the nip portion N is a predetermined sheet type (S2: YES), application of the effective braking force is needed to solve the gloss memory problem, and therefore the control unit 100 outputs the assist signals and the instruction signals including a high-level brake signal shown in FIG. 7 as described below. The selection signal judgment unit 91 then outputs the assist signals to one of the motor boards B1 and B2 on which is mounted the motor M1 or M2 determined as the motor used to generate the assist force D1 in step S1, and the assist force D1 is generated in accordance with the assist signals. On the other hand, the selection signal judgment unit 91 outputs a high-level brake signal to the other of the motor boards B1 and B2 so that the braking force D2 is generated.

Next, the control unit 100 determines a predetermined conditions is whether the satisfied (S3). The predetermined conditions are for example whether the temperature detected by either one of the temperature sensors T1 and T2 rises to no lower than a predetermined temperature, whether a predetermined number of sheets S of the predetermined sheet type have been successively passed through the nip portion N, and so forth.

If such a predetermined condition is not satisfied (S3: NO), the control unit 100 terminates the process shown in FIG. 6 (S6) without switching the motor for generating the braking force D2.

Conversely, if such a predetermined condition is satisfied (S3: YES), the control unit 100 determines whether the sheet S, which is to be next conveyed to the nip portion N, has reached a predetermined distance (for example, 50 mm) before the nip portion N (S4). If it is determined that the sheet S has not reached yet the predetermined distance before the nip portion N (S4: NO), this step S4 is repeated until the sheet S has reached.

If it is determined that the sheet S has reached the predetermined distance before the nip portion N (S4: YES), the control unit 100 switches the motor for generating the braking force D2 between the motors M1 and M2 (S5). That is, the control unit 100 changes the selection signal to switch the motor used to generate the assist force D1 from one of the motors M1 and M2 which is currently generating the assist force D1 to the other of the motors M1 and M2 which is currently generating the braking force D2. At the same time, the motor used to generate the braking force D2 is switched from one of the motors M1 and M2 which is currently generating the braking force D2 to the other of the motors M1 and M2 which is currently generating the assist force D1. The control unit 100 then terminates the process shown in FIG. 6.

Incidentally, when it is determined in step S3 whether a predetermined number of sheets S of the predetermined sheet type have been successively passed through the nip portion N, this predetermined number is preferably 1. This makes it possible to switch the motor for generating the braking force D2 between the motors M1 and M2 each time a sheet S of the predetermined sheet type is conveyed to the nip portion N, and to balance the motors M1 and M2 in temperature when a plurality of sheets S are successively passed through the nip portion N.

As has been discussed above, if it is determined that the sheet S has reached the predetermined distance before the nip portion N (S4: YES), the control unit 100 switches the motor for generating the braking force D2 between the motors M1 and M2 (S5). This predetermined distance is determined shorter than the interval of adjacent sheets. Because of this, it is possible to switch the motor for generating the braking force D2 between the motors M1 and M2 when the nip portion N is relatively located in an interval between adjacent sheets so that no sheet S is located in the nip portion N. The effective braking force exerted on the upper pressure roller 61 may temporarily become unstable when switching the motor for generating the braking force D2 between the motors M1 and M2. However, since there is no sheet S in the nip portion N with this switching timing, it is possible to avoid the situation that the gloss memory problem cannot be solved due to such an unstable effective braking force.

Figure 7:
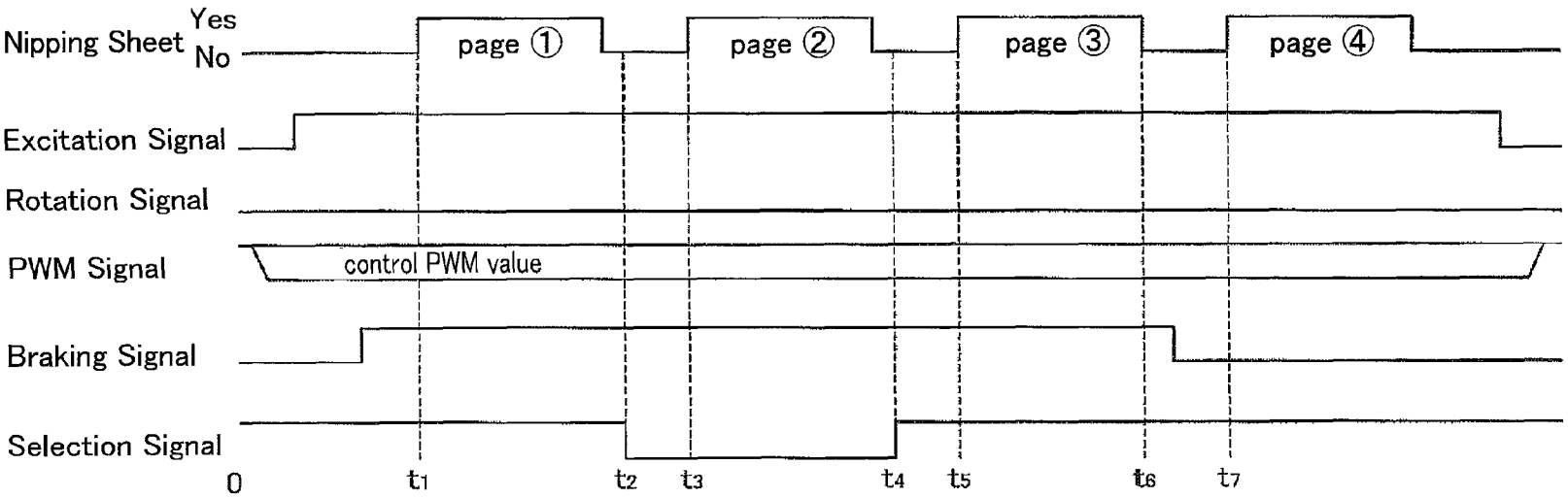
FIG. 7 is a timing chart showing the timed relationship of the control signals used in the fixing apparatus of the present embodiment.

Next, the control signals used in the fixing apparatus of the present embodiment will be explained. FIG. 7 is a timing chart showing the timed relationship of the control signals used in the fixing apparatus of the present embodiment will be explained. Incidentally, FIG. 7 shows an example of the control scenario for switching the motor for generating the braking force D2 between the motors M1 and M2 each time a sheet S of the predetermined sheet type is conveyed to the nip portion N.

First, it is assumed that the control unit 100 outputs a high-level selection signal at time 0. In this case, for example, the selection signal judgment unit 91 outputs the assist signals to the first motor board B1 to generate the assist force D1 from the first motor M1, and outputs the brake signal to the second motor board B2 to generate the braking force D2 from the second motor M2.

As described above, the assist signals output to the first motor board B1 consist of an excitation signal, a rotation signal and a PWM. Incidentally, as shown in FIG. 7, the rotation signal is fixed to a low level. This is because the rotation direction is not changed when applying the assist force D1.

On the other hand, the second motor board B2 receives a high-level brake signal and drives the second motor M2 to maintain the position of the rotor and generate the braking force D2.

Next, the first sheet S of the predetermined sheet type is conveyed to the nip portion N at time t1. At this time, the upper pressure roller 61 receives the effective braking force which is a combination of the assist force D1 and the braking force D2. The gloss memory problem of the first sheet S is therefore solved. The first sheet S is then discharged from the nip portion N.

Next, it is assumed that the subsequent sheet S (the second sheet S) to be conveyed to the nip portion has reached the predetermined distance before the nip portion N at time t2. At this time, the control unit 100 outputs a low-level selection signal. In this case, for example, the selection signal judgment unit 91 outputs the assist signals to the second motor board B2 to generate the assist force D1 from the second motor M2, and outputs the brake signal to the first motor board B1 to generate the braking force D2 from the first motor M1.

Next, at time t3, the second sheet S of the predetermined sheet type has reached the nip portion N and then is conveyed by the nip portion N. At this time, the upper pressure roller 61 is receiving the effective braking force which is a combination of the assist force D1 and the braking force D2. The gloss memory problem of the second sheet S is therefore solved in the same manner. The second sheet S is then discharged from the nip portion N.

Next, it is assumed that the subsequent sheet S (the third sheet S) to be conveyed to the nip portion has reached the predetermined distance before the nip portion N at time t4. At this time, the control unit 100 outputs a high-level selection signal. In response to this, for example, the selection signal judgment unit 91 outputs the assist signals to the first motor board B1 to generate the assist force D1 from the first motor M1, and outputs the brake signal to the second motor board B2 to generate the braking force D2 from the second motor M2.

Next, at time t5, the third sheet S of the predetermined sheet type has reached the nip portion N and then is conveyed by the nip portion N. The upper pressure roller 61 then receives the effective braking force which is a combination of the assist force D1 and the braking force D2. The gloss memory problem of the third sheet S is therefore solved in the same manner. The third sheet S is then discharged from the nip portion N at time t6.

It is assumed here that the subsequent fourth sheet S is not a predetermined sheet type. In this case, the control board 90 outputs a low-level brake signal to the second motor board B2. The second motor board B2 thereby makes the second motor M2 stop generating the braking force D2. That is to say, with respect to processing the fourth sheet S which is conveyed to the nip portion N at time t7, only the assist force D1 is applied to the upper pressure roller 61 so that the fourth sheet S can be prevented from wrinkling.

Figure 8:
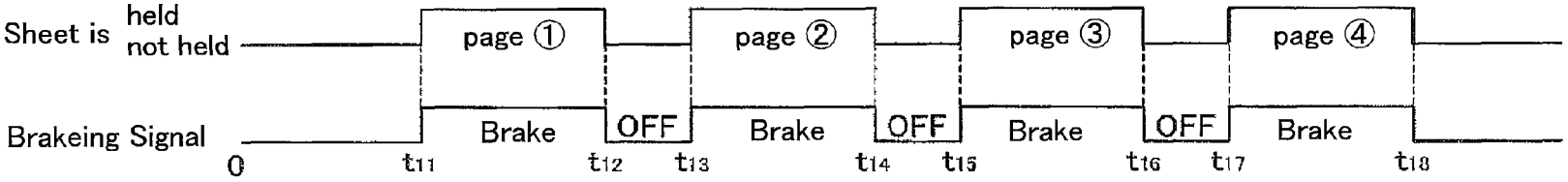
FIG. 8 is a timing chart showing another example of the timed relationship of the control signals used in the fixing apparatus of the present embodiment.

FIG. 8 is a timing chart showing another example of the timed relationship of the control signals used in the fixing apparatus of the present embodiment will be explained. In the previous example shown in FIG. 7, the brake signal is fixed to a high-level while successively passing sheets S of the predetermined sheet type through the nip portion N (i.e., from time t1 to time t6). The braking force D2 is thereby generated alternately by the first and second motors M1 and M2 from time t1 to time t6.

Contrary to this, in this example shown in FIG. 8, the motor M1 or M2 for generating the braking force D2 is turned off (deenergized) when the nip portion N is relatively located in an interval between adjacent sheets conveyed through the fixing nip portion, and turned on (energized) when a sheet is being conveyed by the nip portion N.

Namely, the brake signal is set to the high-level in periods in which the first sheet S is conveyed by the nip portion N, i.e., between time t11 and time t12, and set to the low-level in a period in which no sheet S is conveyed by the nip portion N, i.e., between time t12 and time t13. Likewise, the brake signal is set to the high-level in periods in which the second to third sheets S are conveyed by the nip portion N, i.e., between time t13 and time t14, between time t15 and time t16 and between time t17 and time t18, and set to the low-level in which no sheet S is conveyed by the nip portion N, i.e., between time t12 and time t13, between time t14 and time t15, between time t16 and time t17 and after time t18.

The motor M1 or M2 for generating the braking force D2 is therefore turned off when the nip portion N is relatively located in an interval between adjacent sheets conveyed through the fixing nip portion. In other words, this motor is turned off when the effective braking force need not be applied to the upper pressure roller 61, so that it is possible to reduce heat generation of the motors M1 and M2 without compromising the effect of solving the gloss memory problem.

In accordance with the fixing apparatus of the present embodiment as has been discussed above, the motor for generating the braking force D2 is switched among a plurality of motors, i.e., between the motors M1 and M2. Because of this, the motor which functioning as an electric generator is successively switched between the motors M1 and M2 in order to prevent heat generation from being concentrated to one of the motors M1 and M2. Accordingly, while the gloss memory problem is solved by the use of the braking force, it is possible to reduce the possibility of damaging the motors M1 and M2.

In addition to this, the motor for generating the braking force D2 is switched between the motors M1 and M2 when the nip portion N is relatively located in an interval between adjacent sheets conveyed through the fixing nip portion. While the effective braking force exerted on the upper pressure roller 61 may temporarily become unstable when switching the motor for generating the braking force D2 between the motors M1 and M2, there is no sheet S in the nip portion N with this switching timing, and therefore it is possible to avoid the situation that the gloss memory problem cannot be solved due to such an unstable effective braking force.

Furthermore, the motor M1 or M2 for generating the braking force D2 is turned off when the nip portion N is relatively located in an interval between adjacent sheets conveyed through the fixing nip portion, and turned on when a sheet is being conveyed by the nip portion N. The motor M1 or M2 for generating the braking force D2 is turned off while the effective braking force need not be applied to the upper pressure roller 61, so that it is possible to reduce heat generation of the motors M1 and M2 without compromising the effect of solving the gloss memory problem.

Also, each time a sheet S of the predetermined sheet type is conveyed to the nip portion N, the motor used to generate the braking force D2 is switched between the motors M1 and M2. The motor used to generate the braking force D2 can therefore be changed for each sheet S to balance the motors M1 and M2 in temperature.

Also, each time either of the temperatures of the plurality of motors M1 and M2 and driver circuits for driving the plurality of motors M1 and M2 reaches a predetermined temperature, the motor used to generate the braking force D2 is switched between the motors M1 and M2. Because of this, it is possible to readily switch the motor used to generate the braking force D2 between the motors M1 and M2 before failure occurs in either of the motors M1 and M2 and driver circuits. The possibility of failure occurring in either of the motors M1 and M2 and driver circuits can therefore be reduced by minimizing the frequency that application of the effective braking force become unstable due to switching the motor used to generate the braking force D2 between the motors M1 and M2.

In conclusion, it is possible to output printed sheets having improved image gloss by the image forming apparatus according to the present embodiment provided with the image formation block 40 capable of forming a toner image on a sheet S and the fixing apparatus as described above which can fix toner images formed by the image formation block 40 to the sheet S while avoiding the failure of the motors M1 and M2.

The foregoing description has been presented on the basis of the embodiments. However, it is not intended to limit the present invention to the precise form described, and obviously many modifications and variations are possible without departing from the scope of the invention.

For example, in the case of the above embodiments, the fixing apparatus is a belt nip type unit. However, the present invention is not limited thereto but can be applied to a roller nip type fixing apparatus.

Also, in the case of the above embodiments, the fixing apparatus is housed in the image forming apparatus 1. However, the present invention is not limited thereto but can be applied even if the fixing apparatus is installed in a finisher or another apparatus.

In addition to this, the configurations, the numerals and the like are not limited to those as described above, but can be changed in any appropriate manner.

Furthermore, in the case of the fixing apparatus of either of the above embodiments, the motor for generating the braking force D2 is switched between the two motors M1 and M2. However, the present invention is not limited thereto but can be applied to a fixing apparatus in which the motor used to generate the braking force D2 is switched among three or more motors.

Also, in the case of the above embodiments, the temperature sensors T1 and T2 detect the temperatures of the motors M1 and M2 and the temperatures of the driver circuits. However, the temperature sensors T1 and T2 can be used to detect only the temperatures of the motors M1 and M2 or only the temperatures of the driver circuits.

Furthermore, in the case of the above embodiments, the control unit 100 switches the motor used to generate the braking force D2 between the two motors M1 and M2 when either of the temperatures detected by the temperature sensors T1 and T2 reaches a predetermined temperature, or when a predetermined number of sheets S of the predetermined sheet type have been successively passed through the nip portion N. However, the control unit 100 is not limited to this configuration. For example, the control unit 100 can switch the motor used to generate the braking force D2 between the two motors M1 and M2 with another timing such as with a timing when the job is switched.

Still further, in the case of the above embodiments, the fixing apparatus includes the control board 90 and receives the selection signal output from the control unit 100 by the selection signal judgment unit 91 which interprets the selection signal and outputs the assist and brake signals to the motor boards B1 and B2 respectively. However, the fixing apparatus is not limited thereto, but the control unit 100 can determine the destination of the brake signal and the destination of the assist signals, and outputs the assist and brake signals directed to the motor boards B1 and B2 respectively with no intervention of the control board 90.

What is claimed is:

1. A fixing apparatus comprising:

a fixing side member configured to rotate;

a back side member configured to rotate in contact with the outer peripheral surface of the fixing side member under pressure, and cooperate with the fixing side member for forming a fixing nip portion which holds and conveys a sheet with a toner image therebetween;

a drive motor configured to rotate the back side member;

a braking force generation unit including a plurality of motors each of which is capable of generating a braking force in the direction to hinder rotation of the fixing side member and an assist force in the direction to assist rotation of the fixing side member, and configured to generate an effective braking force in the direction to hinder rotation of the fixing side member as a combination of the braking and assist forces; and a control unit configured to switch the motor used to generate the braking force among the plurality of motors in accordance with a predetermined condition.

2. The fixing apparatus of claim 1 wherein the control unit switches the motor used to generate the braking force when the nip portion is relatively located in an interval between adjacent sheets conveyed through the fixing nip portion.

3. The fixing apparatus of claim 1 wherein the control unit turns off the motor used to generate the braking force when the nip portion is relatively located in an interval between adjacent sheets conveyed through the fixing nip portion, and turns on the motor used to generate the braking force when a sheet is being conveyed by the nip portion.

4. The fixing apparatus of claim 1 wherein the control unit switches the motor used to generate the braking force each time a sheet is conveyed to the nip portion.

5. The fixing apparatus of claim 1 further comprising:

a temperature sensor configured to detect the temperatures of the plurality of motors and/or the temperatures of driver circuits for driving the plurality of motors, wherein the control unit switches the motor used to generate the braking force each time the temperature sensor detects a predetermined temperature or higher.

6. An image forming apparatus comprising:

an image forming unit configured to form a toner image on a sheet; and a fixing unit as recited in claim 1 to fix the toner image formed on the sheet.

* * * * *